United States Patent [19]

Aliprandini

[11] 4,309,256

[45] Jan. 5, 1982

[54] PROCESS FOR THE GALVANOPLASTIC DEPOSITION OF A GOLD ALLOY

[76] Inventor: Pino Aliprandini, 98D, route de Thonon,, CH-1222 Vesenaz, Geneva, Switzerland

[21] Appl. No.: 158,406

[22] Filed: Jun. 11, 1980

[30] Foreign Application Priority Data

Jun. 14, 1979 [CH] Switzerland ..... 5560/79

[51] Int. Cl.[3] ..... G01N 3/62

[52] U.S. Cl. ..... 204/44

[58] Field of Search ..... 204/44, 123

[56] References Cited

U.S. PATENT DOCUMENTS 4,179,344 12/1979 Thomson ..... 204/44

*Primary Examiner*—G. L. Kaplan

*Attorney, Agent, or Firm*—Emory L. Groff, Jr.

[57] ABSTRACT

A method comprising the galvano-plastic deposition of a gold alloy on a cathode in an aqueous bath containing gold in the form of alkali metal and gold cyanide in the presence of alkali metal and copper cyanide, alkali metal and cadmium cyanide, a chelating agent and an organic wetting agent, wherein the conductivity of the bath is adjusted by the addition thereto of an amount of an alkali metal sulfite sufficient to maintain a specific cathodic current density alloy deposition speed.

4 Claims, No Drawings

PROCESS FOR THE GALVANOPLASTIC DEPOSITION OF A GOLD ALLOY

It is known that in galvanoplastic baths for gilding, the current density can be increased by increasing the bath temperature. However, such increase in temperature has the detrimental effect of reducing the yield of the gilding operation. Thus, in increasing the bath temperature from 60° C. to 70° C., the yield decreases from 62 mg/Amp.minute to 54 mg/Amp.minute.

It has been found that in a galvanoplastic bath containing a base of potassium auro-cyanide, potassium cupro-cyanide, potassium cadmio-cyanide and free potassium cyanide brought to a temperature of from 70° to 75° C., it is possible to increase the galvanic deposition of an Au, Cu, Cd alloy in substantial proportions by the addition of sodium or potassium sulphite to the bath and doubling or tripling the current density.

According to the present invention there is provided a process for the galvanoplastic deposition of a gold alloy on a cathode to be gilded in a bath containing 3 to 5 gr/l of gold metal in the form of an alkaline aurocyanide, in the presence of organo-metallic compounds of copper and cadmium, a complexing agent and an organic wetting agent, and maintained at a temperature of from 70° to 75° C. and at a pH of from 9 to 11, in which the electric conductibility of the bath is adjusted by the addition of an alkaline sulphite, in a manner to obtain a cathodic current density of from 2 to 3 Amp/dm$^2$ and an alloy deposition speed of greater than 0.65$\mu$ per minute.

In order to compensate for the lowering of the yield, it is proposed to increase the electric conductibility of the bath by the addition of an alkaline sulphite, which permits increasing in a substantial manner the deposition speed of an Au, Cu, Cd alloy without having to increase the concentration of the bath by the same amount with potassium aurocyanide.

In increasing notably, on the other hand, the concentration of the bath with potassium cadmio-cyanide and the amount of its complexing agent, for example nitrilo-triacetic acid, it is possible to reduce the amount of gold in the Au, Cu, Cd alloy deposition on the cathode.

The following Example 2 illustrates the above mentioned advantages of the process in accordance with the invention, Example 1 being a prior art process.

EXAMPLE 1

(classical process)

The metals destined to constitute the alloy are incorporated in the bath in the form of an alkaline metallo-cyanide or an other organo-metallic compound. Their concentration would always be expressed in weight of metal per liter of bath.

Au: 4 to 5 gr/l
Cu: 60 gr/l
Cd: 0.6 to 0.8 gr/l
free KCL: 23 to 27 gr/l
Nitrilo-triacetic acid: 4–6 gr/l Polyoxyalkoylenic wetting agent: 2 cc/l
pH: 9.5 to 10.5
Temperature: 60° C.
Current density: 0.8 to 1.2 Amp/dm$^2$*
*Amp/dm$^2$ of surface to be gilded (cathode)
Deposition speed: 1$\mu$ per 2.5 to 3.5 min.
2 N carat: 18–19

EXAMPLE 2

(Process in accordance with the invention)

Au: 3 to 5 gr/l
Cu: 50 to 60 gr/l
Cd: 2 to 3 gr/l
Free KCN: 22 to 29 gr/l
Nitrilo-triacetic acid: 10 to 20 gr/l
$Na_2SO_3$ or $K_2SO_3$: 18 to 22 gr/l (preferably 20 gr/l)
Polyoxalkoylenic wetting agent: 1 to 3 cc/l (preferably 2 cc/l)
pH: 9 to 11
Temperature: 70° to 75° C.
Current density: 2 to 3 Amp/dm$^2$
Deposition speed: 1$\mu$ per 1 to 1.5 min.
2 N Carat: 17–18

Thus, there is deposited 2 to 3 times more gold alloy per minute in accordance with the process of Example 2, whilst maintaining the concentration of gold in the bath such as in Example 1. Moreover, the amount of gold alloy deposited expressed in 2 N carat is found to be lowered and there is thus effected an economy of gold of around 4% for an equivalent quality of alloy deposition.

On the other hand, the process in accordance with the invention permits substantial variations in concentration of metal (Cd 2 to 3 gr/l instead of 0.6 to 0.8 gr/l), of nitrilo-triacetic acid (10 to 20 gr/l instead of 4 to 6 gr/l), of the pH (9 to 11) instead of 9.5 to 10.5), of current density (2 to 3 Amp/dm$^2$ instead of from 0.8 to 1.2 Amp/dm$^2$, which gives a greater stability to the bath.

I claim:

1. A method comprising the galvano-plastic deposition of a gold-copper-cadmium alloy on a cathode in an aqueous bath containing 3 to 5 gr/l of gold in the form of alkali metal and gold cyanide, 50 to 60 gr/l of copper in the form of alkali metal and copper cyanide, 2 to 3 gr/l of cadmium in the form of alkali metal and cadmium cyanide, a chelating agent, an organic wetting agent and an amount from 18 to 22 gr/l of an alkali metal sulfite sufficient to maintain a cathodic current density of from 2 to 3 amp/dm$^2$ and an alloy deposition speed of greater than 0.65 micron thickness per minute, said bath being maintained at a temperature of from 70° to 75° C. and at a pH of from 9 to 11.

2. The method of claim 1 wherein said bath contains an additional 22 to 29 gr/l of free alkali metal cyanide.

3. The method of claim 1 wherein said chelating agent is nitrilo-triacetic acid and is present in an amount of from 10 to 20 gr/l.

4. The method of claim 1 wherein said wetting agent is polyoxyalkylenic and is present in an amount from 1 to 3 cc/l.

* * * * *